US007442043B2

(12) United States Patent
Yuan et al.

(10) Patent No.: US 7,442,043 B2
(45) Date of Patent: Oct. 28, 2008

(54) ELECTRICAL CONNECTOR ASSEMBLY BACKGROUND OF THE INVENTION

(75) Inventors: Wei Yuan, ShenZhen (CN); Yu-San Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/986,935

(22) Filed: Nov. 26, 2007

(65) Prior Publication Data

US 2008/0124950 A1 May 29, 2008

(51) Int. Cl.
*H01R 12/00* (2006.01)
*H01R 13/44* (2006.01)
*H01R 13/60* (2006.01)

(52) U.S. Cl. ..... 439/56; 439/135; 439/41

(58) Field of Classification Search ..... 439/56, 439/131, 135, 41, 42

See application file for complete search history.

(56) References Cited

U.S. PATENT DOCUMENTS 4,396,245 A * 8/1983 Lane ..... 439/148
5,613,864 A * 3/1997 Northey ..... 439/149
5,681,174 A * 10/1997 Correll et al. ..... 439/135
5,688,133 A * 11/1997 Ikesugi et al. ..... 439/135
6,283,785 B1 * 9/2001 Daoud ..... 439/409
6,599,140 B1 * 7/2003 Chen et al. ..... 439/135
7,033,189 B1 * 4/2006 Zhang et al. ..... 439/135

* cited by examiner

*Primary Examiner*—Briggitte R Hammond
(74) *Attorney, Agent, or Firm*—Wei Te Chung

(57) ABSTRACT

An electrical connector assembly for electrically connecting a lamp device (2) to a printed circuit board (3) includes an insulative housing (10) having a front slot (101) and a rear slot (103), the rear slot adapted to receive a body of the lamp device. A contact terminal (11) includes a pair of separate deflectable arms (112) disposed within the front slot and adapted to clip a front end of the lamp device. An ejecting member (12) within the front slot is set for enabling the clip action of the deflectable arms of the contact terminal. A pick up device (13) is assembled onto the ejecting member, and includes a base having a planar surface for being sucked by a vacuum suction device for easy to be feed the electrical connector assembly into automated machines.

17 Claims, 4 Drawing Sheets

ELECTRICAL CONNECTOR ASSEMBLY BACKGROUND OF THE INVENTION

BACKGROUND OF THE INVENTION

1. Field of the Invention

The present invention relates to the art of electrical connectors, and more particularly to an electrical connector assembly including an electrical connector for electrically connecting a lamp device to a printed circuit board.

2. Description of the Related Art

Nowadays, LCDs (Liquid Crystal Displays) have become the output device of choice for use in AV (audiovisual) products. The increasing role of LCDs in AV products such as PC (Personal Computer) monitors and TV (Television) displays, has created a need for connectors capable of connecting with a lamp device, wherein the lamp device provides a light source for the LCDs. It is well known that conventional connectors for use with the lamp devices are difficult to be fed into automated machines, because there is no specific device attached onto the connectors for assisting in picking up the connectors. Therefore, there is a need to provide a new electrical connector assembly to resolve the above-mentioned problem.

SUMMARY OF THE INVENTION

A major object of an embodiment of the present invention is to provide an electrical connector assembly easy to be fed into automated machines.

An electrical connector assembly according to an embodiment of the present invention is applicable for electrically connecting a lamp device to a printed circuit board. The electrical connector assembly includes an insulative housing having a front slot and a rear slot, with the rear slot adapted to receive a body of the lamp device. A contact terminal is assembled onto the insulative housing, and includes a pair of separate deflectable arms disposed within the front slot. The deflectable arms are adapted to clip a front end of the lamp device so as to be in electrical contact with the lamp device. An ejecting member is movably disposed within the front slot, and includes a pair of opposite side walls with thereon interior protrusions for enabling the deflectable arms to clip the front end of the lamp device. A pick up device is assembled onto the ejecting member, and includes a base having a planar surface for being sucked by a vacuum suction device for easy to feed the electrical connector assembly into automated machines.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
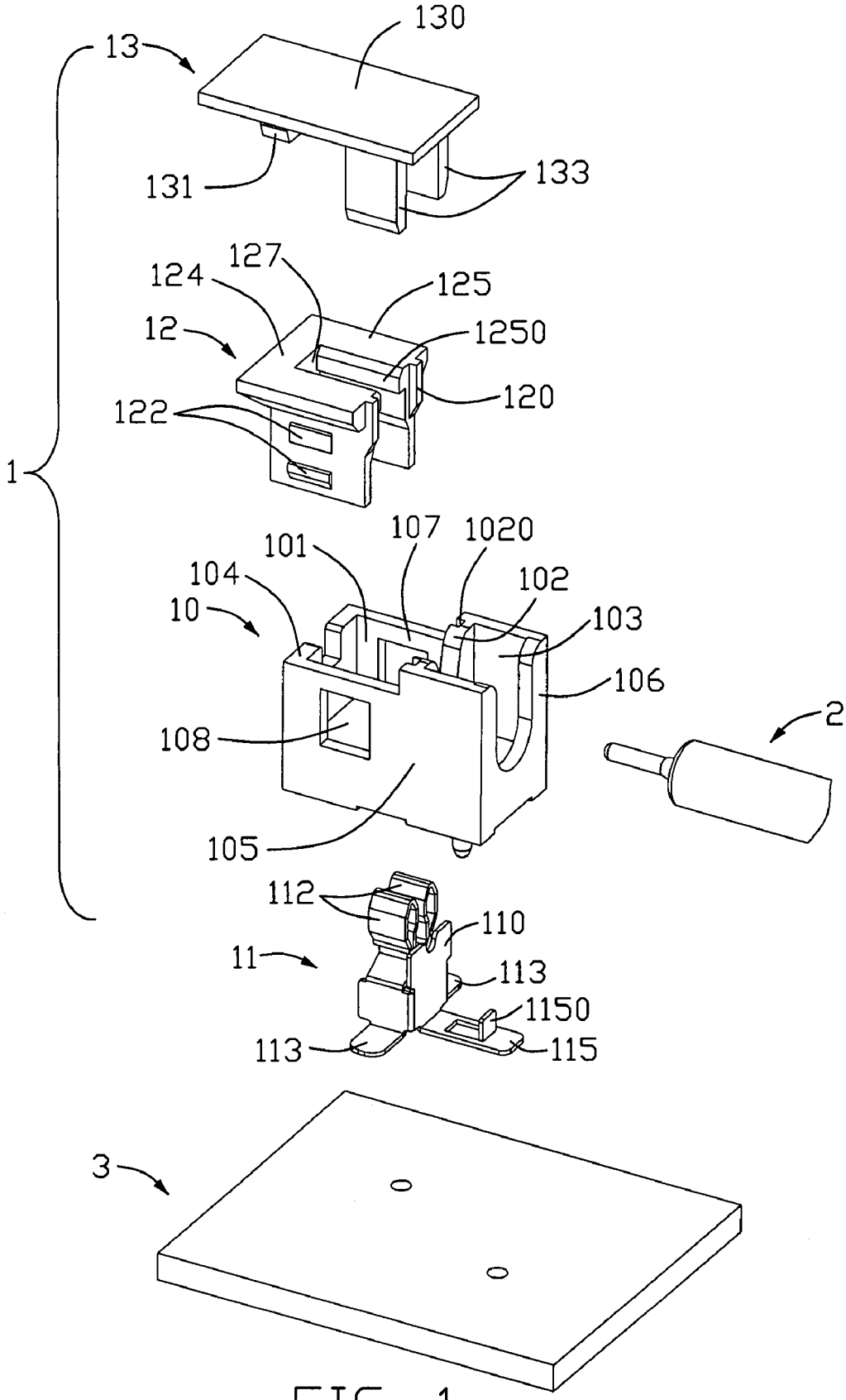
FIG. 1 is an exploded, perspective view of an electrical connector assembly according to an embodiment of the present invention.
Figure 2:
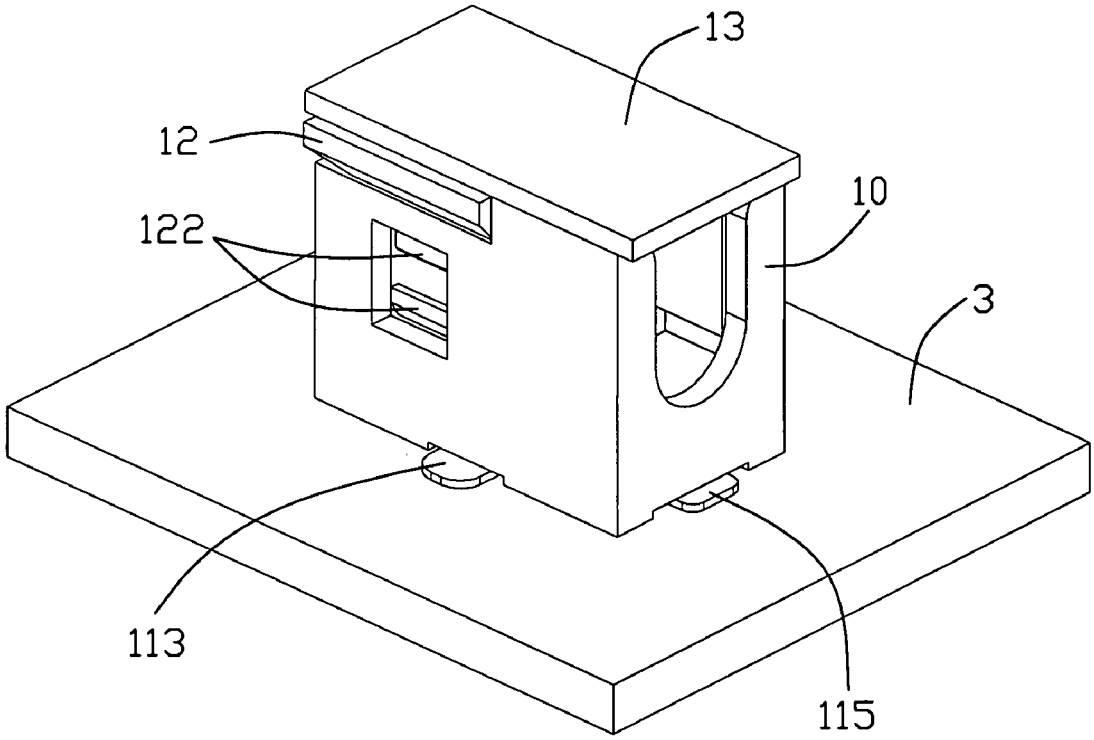
FIG. 2 is an assembled, perspective view of the electrical connector assembly of FIG. 1, but with a lamp device removed therefrom.

Referring to FIGS. 1 and 2, an electrical connector assembly 1 according to an embodiment of the present invention is shown for electrically connecting a lamp device 2 to a printed circuit board 3. The electrical connector assembly 1 includes an insulative housing 10, a contact terminal 11, an ejecting member 12 and a pick up device 13.

Figure 4:
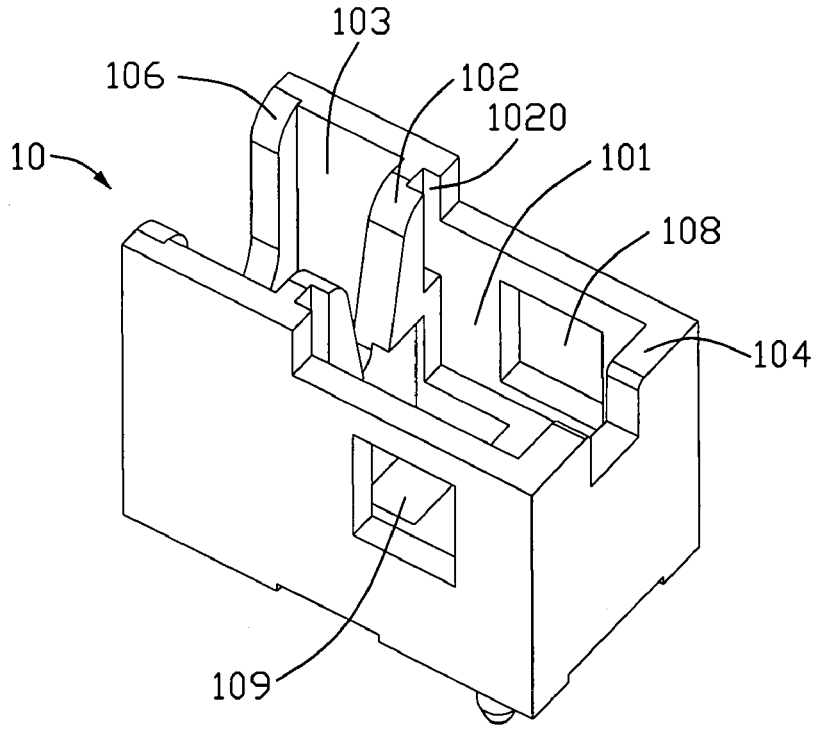
FIG. 4 is a perspective view of an insulative housing of the electrical connector assembly of FIG. 1.

Referring to FIG. 4, the insulative housing 10 includes a front slot 101 and a rear slot 103 divided by a middle wall 102 therebetween. The front slot 101 is further defined by a front wall 104, a right wall 105, a left wall 107 and the middle wall 102, while the rear slot 103 is further defined by a rear wall 106, the right wall 105, the left wall 107 and the middle wall 102. The rear slot 103, with the rear wall 106 and the middle wall 102 defining U-shaped slots of different sizes, is adapted for receiving a body of a lamp device 2. The front slot 101, with the right wall 105 and the left wall 107 defining rectangular windows 108 of same sizes, is adapted for receiving the ejecting member 12 therein and for allowing the ejecting member 12 to be movable in an up-to-down direction relative to the insulative housing 10 through the use of spaced exterior protrusions 122 of the ejecting member 12 within the windows 108 of the insulative housing 10 (to be later described). The middle wall 102 further defines grooves 1020 for receiving outside ribs 120 of the ejecting member 12 so as to assist in the up-to-down movement of the ejecting member 12 along the insulative housing 10. In addition, the insulative housing 10 includes a bottom retention aperture 109 for retaining the contact terminal 11 onto the insulative housing 10.

Figure 5:
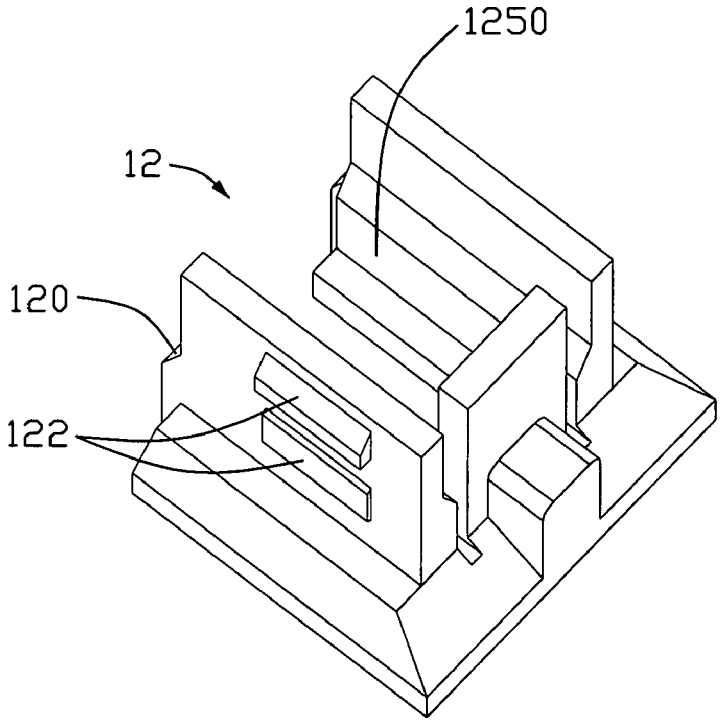
FIG. 5 is a perspective view of an ejecting member of the electrical connector assembly of FIG. 1.

Referring to FIG. 5, the ejecting member 12 is of an U-shaped configuration formed by a front wall segment 124 and a pair of opposite side wall segments 125. The opposite side wall segments 125 are spaced from each other so as to define an elongated slot 127 therebetween for interferingly receiving the pick up device 13 therein. The opposite side wall segments 125 include a pair of stepped interior protrusions 1250 thereon at opposite sides of the elongated slot 127 for enabling a pair of separate deflectable arms 112 to be more closer so as to clip a front end of the lamp device 2, when the ejecting member 12 moves downwardly relative to the insulative housing 10. The clip action of the deflectable arms 112 of the contact terminal 11 to the lamp device 2 will cause the contact terminal 11 to be in direct contact with the lamp device 2, thereby establishing an electrical connection between the contact terminal 11 and the lamp device 2. The movement of the ejecting member 12 relative to the insulative housing 10 is achieved by the guiding ribs 120 on the rear ends of the opposite side wall segments 125 to be slidably engagable with the grooves 1020 of the insulative housing 10, and a pair of exterior protrusions 122 on each side wall segment 125 of the ejecting member 12 to be movable within a predetermined distance determined by a height of each window 108 of the insulative housing 10.

Figure 6:
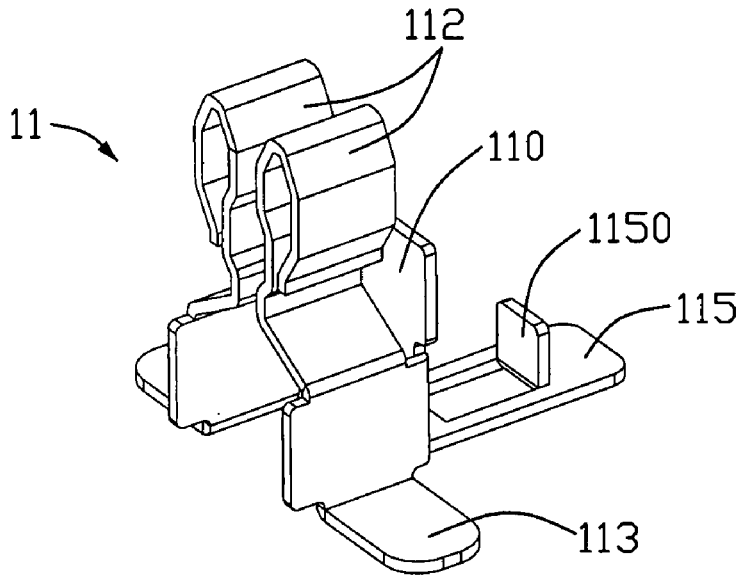
FIG. 6 is a perspective view of a contact terminal of the electrical connector assembly of FIG. 1.

Referring to FIG. 6, the contact terminal 11 includes a terminal base 110, a pair of spaced deflectable arms 112 disposed in a symmetrical relationship with respect to the terminal base 110 and extending upwardly from the terminal base 110, two solderable plates 113 and a retention plate 115 attached to a bottom of the terminal base 110. As shown in FIG. 1, the solderable plates 113 are adapted to be soldered onto the printed circuit board 3. The retention plate 115 further includes a retention tab 1150 extending upwardly therefrom to be inserted within the insulative housing 10 so as to retain the contact terminal 11 onto the insulative housing 10. It should be noted that the retention plate 115 and two solderable plates 113 are disposed in a common plane to form a triangle arrangement.

Figure 7:
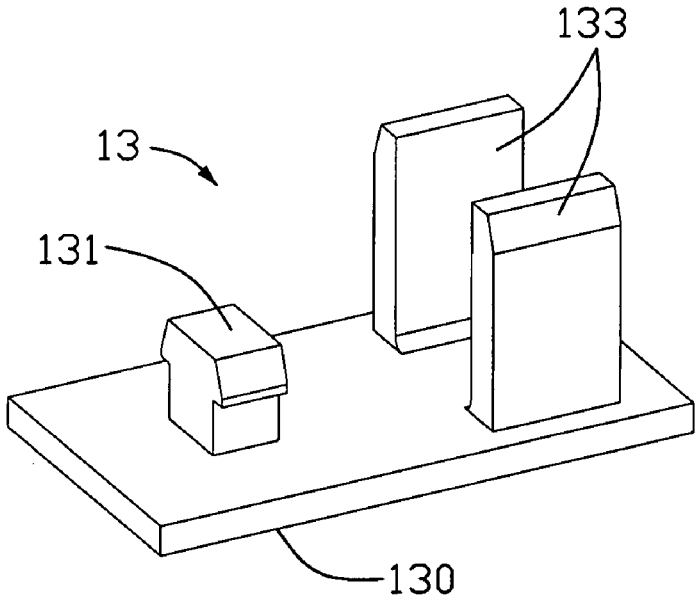
FIG. 7 is a perspective view of a pick up device of the electrical connector assembly of FIG. 1.

Referring to FIG. 7, the pick up device 13 includes a base having a top planar surface 130 for being sucked by a vacuum suction device for easy to feed the electrical connector assembly 1 into automated machines. The base of the pick up device 13 further includes a first base segment with a first retention leg 131 extending downwardly therefrom, and a second base segment with a pair of second retention legs 133 also extending downwardly therefrom. The pick up device 13 is assembled onto the ejecting member 12 and the insulative housing 10 by the first retention leg 131 interferingly retained within the opening 127 of the ejecting member 12 and the second retention legs 133 engageable with the walls of the rear slot 103 of the insulative housing 10. Such a pick up device 13 has the first base segment covering the ejecting member 12 adjacent the opening 127, and the second base segment covering the insulative housing 10 adjacent the rear slot 103.

Figure 3:
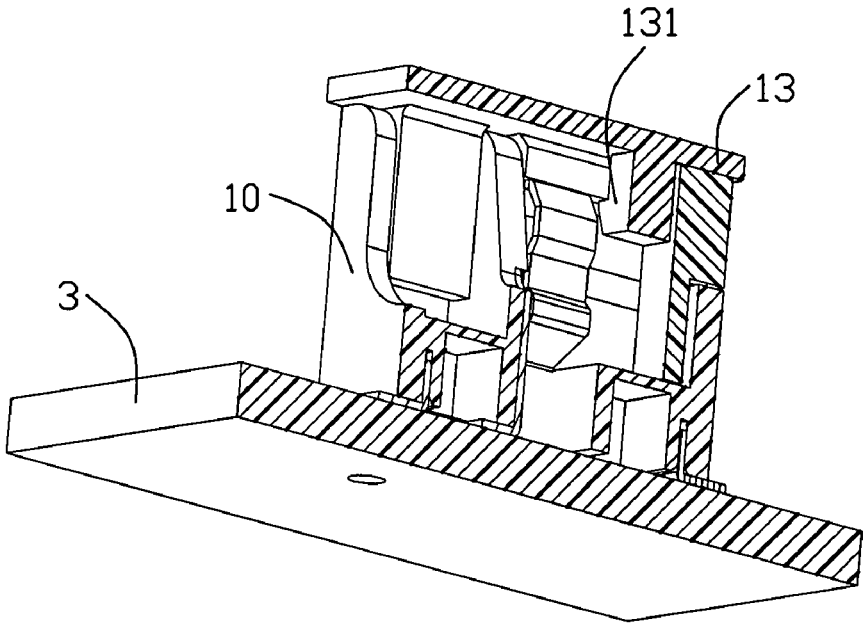
FIG. 3 is a cross sectional view of the electrical connector assembly of FIG. 2.

Referring to FIGS. 1-3, in assembly, the contact terminal 11 is assembled onto the insulative housing 10 by its retention tab 1150 received within the insulative housing 10, and the terminal base 110 inserted through the bottom retention aperture 109 into the insulative housing 10. The lamp device 2 is inserted into the space defined by the deflectable arms 112 of the contact terminal 11. The ejecting member 12 is then assembled onto the insulative housing 10 by the guiding ribs 120 slidably engageable with the grooves 1020 of the insulative housing 10, and the exterior protrusions 122 movably received within each window 108 of the insulative housing 10. The downward movement of the ejecting member 12 relative to the insulative housing 10 causes the deflectable arms 112 of the contact terminal 11 to clip the front end of the lamp device 2 through the use of the interior protrusions 1250 of the ejecting member 12 laterally pressing against the pair of spaced deflectable arms 112 of the contact terminal 11. The pick up device 13 is assembled onto the ejecting member 12 and the insulative housing 10 by its first retention leg 131 interferingly received within the opening 127 of the ejecting member 12, and its second retention legs 133 engageable with the walls of the rear slot 103 of the insulative housing 10. The electrical connector assembly with the lamp device 2 disposed therein is then assembled onto the printed circuit board 3 by the solderable plates 113 of the contact terminal 11 soldered onto corresponding regions of the printed circuit board 3. As compared with the prior art, the electrical connector with the pick up device 13 attached thereon is easy to be fed into automated machined by a vacuum suction device.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector assembly for electrically connecting a lamp device to a printed circuit board, the electrical connector assembly comprising:

an insulative housing having a front slot and a rear slot, the rear slot adapted to receive a body of the lamp device;

a contact terminal assembled onto the insulative housing, the contact terminal having a pair of separate deflectable arms disposed within the front slot, the deflectable arms adapted to clip a front end of the lamp device so as to be in electrical contact with the lamp device;

an ejecting member movably disposed within the front slot, the ejecting member having a pair of opposite side walls with thereon interior protrusions for enabling the deflectable arms to clip the front end of the lamp device; and a pick up device assembled onto the ejecting member, the pick up device including a base having a planar surface for being sucked by a vacuum suction device.

2. The electrical connector assembly of claim 1, wherein the base of the pick up device includes a pair of second retention legs adjacent the rear slot for securing the base onto the insulative housing.

3. The electrical connector assembly of claim 1, wherein the side walls of the ejecting member includes exterior protrusions for securing the ejecting member onto the insulative housing.

4. The electrical connector assembly of claim 1, wherein the front slot of the insulative housing is defined by opposite housing walls of the insulative housing, each housing wall having a window for receiving the exterior protrusions therein.

5. The electrical connector assembly of claim 1, wherein the base of the pick up device includes a first retention leg for securing the base onto the ejecting member.

6. The electrical connector assembly of claim 5, wherein the opposite side walls of the ejecting member define therebetween an opening, said first retention leg interferingly retained within the opening.

7. An electrical connector assembly comprising:

a printed circuit board;

an insulative housing mounted upon the printed circuit board and defining an outer cavity and an inner cavity side by side arranged with each other;

a pair of contacts disposed in the outer cavity;

an ejecting member moveably positioned in the outer cavity to displace the contacts;

a pick up cap attachably covering both the outer cavity and the inner cavity.

8. The electrical connector assembly as claimed in claim 7, wherein said ejecting member is up-and-down moveable.

9. The electrical connector assembly as claimed in claim 7, wherein said pick up cap covers the ejecting member.

10. The electrical connector assembly as claimed in claim 7, further including a lamp device extending into both the outer cavity and the inner cavity and having an electrode retained by the pair of contacts.

11. The electrical connector assembly as claimed in claim 10, wherein said ejecting member is provided with a groove to allow the electrode to pass therethrough.

12. The electrical connector assembly as claimed in claim 10, wherein the lamp device includes a larger diametrical section received in the inner cavity and a smaller diametrical section received in the outer cavity.

13. The electrical connector assembly as claimed in claim 12, wherein said smaller diametrical section is the electrode.

14. An electrical connector assembly comprising:

an insulative housing defining an outer cavity and an inner cavity side by side arranged with each other;

a pair of contacts disposed in the outer cavity;

an ejecting member moveably positioned in the outer cavity to deflect the contacts; wherein said ejecting member is equipped with a groove which is dimensioned to allow an electrode of a lamp device to pass therethrough, under a condition that said electrode is engageable with the pair of contacts when said ejecting member is moved to have the pair of contacts closer to each other for sandwiching the electrode therebetween; and a pick up cap covering both said housing and said ejecting member.

15. The electrical connector assembly as claimed in claim 14, wherein said ejecting member is up-and-down moveable relative to the housing.

16. The electrical connector assembly as claimed in claim 14, wherein said inner cavity is dimensioned to receive a larger section of the lamp device, and the outer cavity is dimensioned to receive a smaller section of the lamp device.

17. The electrical connector assembly as claimed in claim 16, wherein said smaller section is said electrode.

* * * * *